United States Patent [19]

Bruno et al.

[11] Patent Number: 4,511,633

[45] Date of Patent: Apr. 16, 1985

[54] GALVANIZED STEEL SHEET PROTECTED BY CHROMIUM AND CHROMIUM OXIDE LAYERS

[75] Inventors: Roberto Bruno; Massimo Memmi, both of Rome, Italy

[73] Assignee: Zincroksid S.p.A., Turin, Italy

[21] Appl. No.: 579,079

[22] Filed: Feb. 10, 1984

[30] Foreign Application Priority Data

Mar. 21, 1983 [IT] Italy ..... 47949 A/83

[51] Int. Cl.[3] ..... C25D 3/04

[52] U.S. Cl. ..... 428/666; 428/629; 428/659

[58] Field of Search ..... 428/659, 629, 666

[56] References Cited

U.S. PATENT DOCUMENTS

| | | | |
|---|---|---|---|
| 3,323,881 | 6/1967 | Nelson et al. | 428/666 |
| 3,428,441 | 2/1969 | Du Rose et al. | 428/666 |
| 3,816,082 | 6/1974 | Austin et al. | 428/666 |
| 4,159,230 | 6/1979 | Barnes et al. | 428/666 |
| 4,411,964 | 10/1983 | Hara et al. | 428/629 |
| 4,421,828 | 12/1983 | Alloue et al. | 428/666 |
| 4,437,944 | 3/1984 | Bruno et al. | 204/28 |

*Primary Examiner*—Veronica O'Keefe

*Attorney, Agent, or Firm*—Young & Thompson

[57] ABSTRACT

Steel sheet, especially suitable for car-body fabrication, galvanized and further protected by a layer of metallic chromium and hydrated oxides of chromium, electrolytically deposited. The improvement is that the metallic chromium is present in extremely fine particles that exert a very marked covering and protective effect on the underlying zinc. In this way, and with the help of the chromium oxides that further cover and protect the underlying layers, a product is obtained whose corrosion resistance is far superior to that of similar products.

6 Claims, No Drawings

GALVANIZED STEEL SHEET PROTECTED BY CHROMIUM AND CHROMIUM OXIDE LAYERS

This invention relates to improved coated steel sheet. More precisely, it relates to galvanized steel sheet further protected by a coating of metallic chromium and hydrated oxides of chromium electrolytically deposited on the zinc.

Similar products have already been amply described in the literature, such as, for instance, in French Pat. No. 2,053,038, British Pat. No. 1,331,844 and Japanese Pat. No. 47-29233. Their corrosion characteristics reported in the literature and confirmed by tests made during the research that led to the present invention, are good, but in some cases they still do not meet the standards needed for particularly demanding applications. For instance, there is a world-wide trend toward the use of high-strength steel strip thinner than that presently adopted for the construction of car bodies. However, the corrosion resistance of these steels is comparable with that of the normal carbon steels they are intended to replace. Thus, because of the fact that the sheet is thinner, serious corrosion damage, such as perforation, may occur in a shorter time.

Similarly, in some parts of car bodies, such as the floor and the lower zones in general, particularly exposed to the deleterious effects of trapped moisture and the salt used to keep roads ice-free in winter, serious forms of corrosion can occur very rapidly. The steel used to build car bodies must thus be made more corrosion resistant; the first answer has been galvanization, but there are several objectional features here that are well known to the experts, such as the welding difficulties, the fact that the products of corrosion of zinc cause paint to flake off, the problems that arise at a mixed-material joint such as the joint between coated and uncoated steel sheets, etc.

These drawbacks of galvanized sheet have been partly overcome by means of a further coating based on chromium and chromium oxides. However, products of this kind have still not been adopted for a variety of reasons, such as the existence on the market of prepainted sheet; this was originally considered ideal, but since then there have been second thoughts owing to the higher cost and especially the fact that its corrosion resistance is not good enough to meet the better performance now needed in this regard.

The object of the present invention is to provide galvanized sheet further protected by a layer of chromium and hydrated oxides of chromium, which is relatively cheap and whose corrosion resistance is decidedly superior to that of similar coatings described in the literature.

The manner in which this type of product attains high corrosion resistance can be outlined in the following manner:

The zinc is sacrificial vis-a-vis the steel, so it exerts good protective action; however, the products of corrosion of the zinc are somewhat incoherent and cause the overlying paint layer to peel off. Furthermore, in some situations—a mixed-material joint, for example—local alkalinization is favored by the persistence of water or moisture in poorly ventilated zones, followed by saponification and flaking off of the paint. The chromium protects the zinc in such situations; however, the chromium layer is very thin because of cost, so it does not provide perfect coverage of the zinc. The chromium oxides that precipitate in colloidal form, fill the areas left uncovered by the chromium and also protect the latter.

In the product described so far as illustrating the state of the art, the chromium and chromium oxide coatings are extremely thin. Tests we have made on products obtained according to the known processes show that the layer of chromium is composed of a certain number of relatively coarse chromium particles, averaging around 0.1 micron in size, which leave large areas uncovered between them. The layer of complex hydrated oxides covers everything, but it is rather soluble in alkaline environments and is thus sensitive to the type of local alkalinization referred to above.

According to the improvements made by the present invention, instead, the layer of metallic chromium is composed of very small discrete, crystalline, superposed particles, having average Gaussian dimensions of around 0.03 micron, with at least 40% by volume of the metallic chromium being in the form of particles measuring 0.02 micron or smaller. The maximum statistical particle size is about 0.07–0.08 micron. Furthermore, the layer of colloidal, non-crystalline chromium oxides is practically insoluble in water and alkalis, with very low solubility in acids. The nature of this layer of chromium oxides is still unknown, complete chemical characterization being impossible owing to the small amount of precipitate involved, and to the fact that it is in the amorphous state, so X-ray and electron diffraction methods of analysis cannot be used. However, judging by its insolubility in water and in alkalis and by its very low solubility in acids, it is likely that it is essentially a lightly-hydrated form of $Cr_2O_3$.

The product is further characterized by the fact that the deposit of chromium and chromium oxide contain from 0.2 to 1.0 $g/m^2$ total chromium, typically between 0.4 and 0.6 $g/m^2$, and by a metallic chromium content of 80–90%, the remainder of the chromium being contained in the oxides.

As a result of the extremely fine size of the chromium particles deposited, excellent coverage of the zinc is obtained even at the lower limit of total deposited chromium, the average dimensions of the uncovered areas being smaller than 0.02 micron, while the total proportion of the total zinc area left uncovered is less than 0.1%. This value has been estimated by inspection under a transmission electron microscope of the metallic chromium layer detached from the zinc substrate. No breaks in the coating are to be seen at a magnification of 60,000 times. The improved product as per this invention is extraordinarily corrosion resistant.

Unpainted, flat or Eriksen deep-drawn testpieces of sheet as per this invention were subjected to corrosion tests in the salt-spray (fog) chamber according to the ASTM B 117 method, with a 5% NaCl solution.

The first traces of rust appeared after 900 hours on 5% of the testpieces and after 1200 hours on 20%, while 40% still showed no trace of rusting even after 1500 hours. Other testpieces, cataphoretically-painted and cross-scratched showed no traces of rust after 2000 hours. The paint did not lift at the edges of the scratches, while in the areas farther away no blistering occurred in any testpiece. There is virtually no galvanic couple between this coating and the steel. Comparative tests (as per the ASTM B 117 method) made using testpieces obtained by means of known processes indicate that the unpainted testpieces start to show the first signs of rust after 25 hours, while the painted, scratched testpieces show the first signs after 1850 hours. The paint starts to lift at several points after this period, while many small blisters occur at some distance from the scratches.

Protected steel sheet according to the present invention can be produced by the process disclosed in our copending application entitled "Process for the Production of Galvanized Steel Sheet Protected by Chromium and Chromium Oxide Layers", filed under even date herewith, namely:

Continuously dipping the galvanized steel sheet in an aqueous solution containing from 110 to 170 g/l $CrO_4^{2-}$ ions, from 0.7 to 1.4 g/l $SO_4^{2-}$ ions, from 0.4 to 1 g/l $Cr^{3+}$ ions, from 0.5 to 1.1 g/l $F^-$ ions and from 0.01 to 2 g/l $BF_4^-$ ions, the solution being held at a temperature of between 40° and 55° C. and a pH of between 0.3 and 1, Maintaining a relative velocity of more than 0.5 m/s, preferably between 1 m/s and 3 m/s, between the sheet and the solution, Imposing a cathodic current density of between 40 and 80 A/dm$^2$ on the sheet for a time between 2 and 6 seconds, Extracting the sheet from said bath, eliminating the maximum possible of the adhering solution, Continuously dipping the sheet thus obtained in a second aqueous solution containing from 33 to 52 g/l $CrO_4^{2-}$ ions, from 0.4 to 1 g/l $Cr^{3+}$ ions, from 0.6 g/l $SO_4^{2-}$ ions, from 0.5 to 1.1 g/l $F^-$ ions and from 0.01 to 2 g/l $BF_4^-$ ions, the solution being held at a temperature of between 20° and 35° C. and a pH between 3 and 4.5, Maintaining a relative velocity of more than 0.5 m/s, preferably between 0.5 and 2 m/s, between the sheet and the solution, Imposing a cathodic current density of between 10 and 25 A/dm$^2$ on the sheet for a time between 5 and 20 seconds, and Extracting rinsing and drying the sheet.

The substances in solution are given in terms of ions participating in the reaction and not as compounds, since costs and availability of suitable chemical compounds can vary considerably from place to place and from time to time; in this way the cost of the solutions can be kept to a minimum without being tied to a rigid formula. Other ions are, of course, present in the solutions but these play no specific role and so they are not mentioned.

EXAMPLES 1-3

Coils of galvanized steel strip in industrial sizes of widths between 1 and 1.5 m and a thickness between 0.5 and 1 mm are subjected to the following operations:

First Bath (to deposit metallic chromium)

| | Example 1 | Example 2 | Example 3 | |
|---|---|---|---|---|
| $CrO_3$ to form | 110 | 140 | 165 | g/l of $CrO_4^{2-}$ |
| $H_2SO_4$ (100%) | 0.8 | 0.8 | 0.8 | g/l |
| $Cr^{+3}$ (formed by reduction of $CrO_4^{2-}$) | 0.5 | 0.5 | 0.7 | g/l |
| NaF to form | 0.5 | 0.8 | 0.6 | g/l of $F^-$ |
| $HBF_4$ (100%) to form | 0.9 | 0.9 | 0.9 | g/l of $BF_4^-$ |
| Current density | 50 | 55 | 60 | A/dm$^2$ |
| Treatment time | 5 | 4 | 3 | sec. |

-continued

First Bath (to deposit metallic chromium)

| | Example 1 | Example 2 | Example 3 | |
|---|---|---|---|---|
| Deposit of metallic chromium | 0.5 | 0.55 | 0.6 | g/m$^2$ |

In each example, the pH is maintained at 0.75, the temperature at 45°-50° C., and the relative velocity of the strip and the solution at 2.6 m/sec.

Second Bath (to form chromium oxide deposit)

| | Example 1 | Example 2 | Example 3 | |
|---|---|---|---|---|
| $CrO_3$ to form | 40 | 43 | 47 | g/l of $CrO_4^{2-}$ |
| $H_2SO_4$ (100%) | 0.7 | 0.7 | 0.7 | g/l |
| $Cr^{+3}$ (formed by reduction of $CrO_4^{2-}$) | 0.6 | 0.7 | 0.7 | g/l |
| $H_2O_2$ 36 vol (to reduce $CrO_4^{2-}$ to $Cr^{+3}$) | 1.5 | 2 | 2 | ml/l |
| NaF to form | 0.7 | 0.8 | 0.8 | g/l of $F^-$ |
| $HBF_4$ (100%) to form | 0.06 | 0.09 | 0.2 | g/l of $BF_4^-$ |
| NaOH up to | 15 | 15 | 15 | g/l |
| Current density | 20 | 15 | 15 | A/dm$^2$ |
| Treatment time | 12 | 18 | 15 | sec. |
| Chromium content of chromium oxide deposit | 0.12 | 0.06 | 0.10 | g/m$^2$ |

In this second bath, the pH is maintained between 3 and 3.5, temperature between 25° and 28° C., and relative velocity of strip and solution 1.8 m/sec.

Under salt spray test (ASTM B 117) of the resulting unpainted and painted specimens, the following results are obtained (in hours to form the first traces of rust):

| | Example 1 | Example 2 | Example 3 | |
|---|---|---|---|---|
| Unpainted | >1100 | >950 | >1100 | hours |
| Painted | >2300 | >2000 | >2500 | hours |

What is claimed is:

1. Steel sheet, protected by a zinc coating overlaid with a protective layer of chromium and hydrated oxides of chromium, the chromium metal being in the form of particles having average dimensions of about 0.03 micron, while at least 40% by volume of the metallic chromium is in the form of particles measuring less than 0.02 micron.

2. Steel sheet as claimed in claim 1, in which the protective layer of metallic chromium and hydrated oxides of chromium has a total chromium content of between 0.2 and 1.0 g/m$^2$, the chromium metal accounting for between 80 and 90% of that figure, the remainder being chromium contained in the oxides.

3. Steel sheet as claimed in claim 2, in which the total chromium content of the protective layer is between 0.4 and 0.6 g/m$^2$.

4. Steel sheet as claimed in claim 1, in which the metallic chromium layer leaves uncovered areas averaging less than 0.02 micron in size, the total proportion of uncovered zinc being less than 0.1% of the total area.

5. Steel sheet as claimed in claim 1, in which the chromium-oxide layer is colloidal and non-crystalline and is insoluble in water and alkalis and only very slightly soluble in acids.

6. Steel sheet as claimed in claim 1, in which the maximum particle size of the chromium metal is about 0.07-0.08 micron.

* * * * *